United States Patent [19]

Minter

[11] Patent Number: 4,575,167

[45] Date of Patent: Mar. 11, 1986

[54] ELECTRICAL CONNECTOR FOR PRINTED CIRCUIT BOARDS AND THE LIKE

[76] Inventor: Jerry B. Minter, c/o Components Corporation, Denville, N.J. 07834

[21] Appl. No.: 596,096

[22] Filed: Apr. 2, 1984

[51] Int. Cl.[4] ..... H01R 23/70

[52] U.S. Cl. ..... 339/17 L; 339/221 M; 339/275 B

[58] Field of Search ..... 339/220 R, 221 R, 221 M, 339/17 R, 17 C, 17 L, 17 CF, 17 LM, 176 MP, 275 B; 29/837-843

[56] References Cited

U.S. PATENT DOCUMENTS

| | | | |
|---|---|---|---|
| 2,825,037 | 2/1958 | French | 339/17 LM |
| 3,217,283 | 11/1965 | Shlesinger, Jr. | 339/17 R |
| 3,234,499 | 2/1966 | Paholek et al. | 339/221 R |
| 3,566,343 | 2/1971 | Kinkaid | 339/221 R |
| 3,989,331 | 11/1976 | Hanlon | 339/275 B |
| 4,054,345 | 10/1977 | Sherwood | 339/221 M |
| 4,298,237 | 11/1981 | Griffith et al. | 339/176 MP |
| 4,327,955 | 5/1982 | Minter | 339/176 MP |

FOREIGN PATENT DOCUMENTS

| | | | |
|---|---|---|---|
| 181303 | 3/1955 | Austria | 339/221 R |

*Primary Examiner*—Neil Abrams

[57] ABSTRACT

A rounded wire connector is formed by bending a single piece of wire into a J-shaped configuration consisting of first and second parts joined together by a U-shaped loop and extending in generally parallel directions but with the second part offset in one direction from the first part and having a convex bend to form a contact region. The first part is bent to form an offset that extends from the main portion of the first part in the same direction as the direction of displacement of the second part. Two rows of the connectors can be mounted in a main insulating support member that has rows of holes just wide enough to receive the aforementioned offsets of two rows of the wire connectors. The rows of holes are spaced apart by a distance such that, when the connectors are mounted in the holes by being soldered to conductive pads on the surface of the main insulating support member with the offsets in the holes and extending substantially transversely thereacross, the contact regions of one row of connectors will be spaced from the contact regions of the other row of connectors by a proper distance, less than the thickness of a subsidiary insulating member, to make good mechanical contact with the subsidiary member and good mechanical contact with electrical circuits printed on opposite sides thereof.

11 Claims, 6 Drawing Figures

ELECTRICAL CONNECTOR FOR PRINTED CIRCUIT BOARDS AND THE LIKE

BACKGROUND OF THE INVENTION

1. Field of the Invention

This invention relates to electrical connectors formed of wire and each shaped to be securely held by being soldered into a hole in a supporting printed circuit board so that each connector can press against and make good electrical contact with a conductive area on only one surface along the edge of a subsidiary printed circuit board and yet is prevented from shifting position as a result of cold flow of the solidified solder that is supposed to hold the connector stationary. It further relates to connector means comprising pairs of such wire connectors soldered in mirror-image relationship in parallel rows of holes in the supporting board to apply pressure against opposite surfaces of the subsidiary board.

2. The Prior Art

My U.S. Pat. No. 3,340,440 shows several configurations of connectors formed of wire. Each of the connectors has two ends arranged so that they can be inserted in holes in a printed circuit board and soldered to conductive pads on the board immediately around the holes. Each connector consists of one piece of wire bent so that it forms at least one pair of U-shaped loops spaced apart in the plane of the wire connector by a distance that allows one edge of a second, or subsidiary, printed circuit board to be inserted in the gap between the loops. The boards to which the ends of the wire connectors are attached are frequently referred to as "mother boards" and the subsidiary boards inserted between the connector loops are frequently referred to as "daughter boards".

Of all of the connector configurations shown in the aforesaid U.S. Pat. No. 3,340,440, the one that has achieved the greatest commerical success is the one that resembles an "M". That connector has two side wire portions, each of which has a straight section and a U-shaped loop. In each of the U-shaped loops, the wire is curved toward the other loop and is in the same plane as the other loop. The continuous section of wire that joins the two loops and constitutes the central part of the connector is also formed in the shape of a "U", which is open in the opposite direction from the U-shaped loops of the side wire portions. The sides of the central U-shaped portion are tilted or curved slightly toward each other so that juxtaposed contact areas of the two U-shaped loops of the side wire portions can receive an edge of a daughter board and make electrical and mechanical pressure contact with the opposite surfaces of the board at locations spaced slightly away from that edge.

An M-shaped connector of the type just described cannot be used with a type of printed circuit daughter board in which contact areas directly aligned with each other on opposite surfaces are not supposed to be short-circuited together. It frequently is important to provide such a large number of electrically separate connection areas spaced along a certain length of printed circuit board edge that the connection areas on one surface must be electrically isolated from directly opposite connection areas of the opposite surface. Since the edge of the daughter board is grasped by two contact areas of each M-shaped connector, each connection area on one surface of that edge is directly connected by the central part of the connector to a corresponding area on the opposite surface. Thus, the two connection areas on the board are unavoidably short-circuited by the connector, even though it would be desirable for those connection areas to be connected to different circuits on the board.

It would appear that such short-circuiting connection between the two contact areas of an M-shaped connector could be avoided by simply cutting off the central part of the connector, leaving just the side wire portions, each of which would then be J-shaped. Rather than forming the complete M-shaped connector and cutting the central part away, just the J-shaped members would be formed. However, experimentation has shown that such a simple solution does not work. The two side wire portions of a complete M-shaped connector help align each other for insertion in a pair of holes in a mother board, and the two contact areas of the side loops are automatically in confronting relation. While they may require jigs to space them exactly correctly apart, as described in my U.S. Pat. No. 3,940,849, such spacing is made permanent by the solder that solidifies around the straight section of each of the side wire portions. A substantial part of the resilient force that presses the two contact areas of an M-shaped connector firmly against opposite surfaces of a daughter board is provided by the resilience of the central part of the connector, and although there is some outward force on the solder that holds the side wire portions in place in the mother board, such force is not great enough to cause sufficient cold flow of the solder to affect the spacing between the contact areas substantially.

That is not the case with simple J-shaped connectors. The holes into which the straight wire portions of M-shaped connectors are inserted are substantially larger than the connector wire, e.g., about 0.031" for an M-shaped connector made of 0.0201" diameter wire. Attempting to hold J-shaped connectors formed from just the side portions of an M-shaped connector of 0.0201" diameter wire in 0.031" diameter holes resulted in unacceptable shifting of the supposedly rigidly fixed connectors due to cold flow of the solder. The pressure of each contact area against one surface of a daughter board is only about one ounce, but due to the small diameter of the wire, that small contact pressure results in a force of about 2000 p.s.i. on the solder. Solder will cold flow, even at room temperature, at pressures as low as a few hundred p.s.i. or even less than 100 p.s.i. at 80° C. The change in positions of pairs of juxtaposed contact areas of two such J-shaped connectors is so great that the contact pressure on the daughter board falls to an unacceptably low value after only a few days of use.

There is a further disadvantage of simply forming J-shaped connectors shaped identically with the loops and straight sections of side wire portions of the prior art M-shaped connectors. In the M-shaped configuration it is necessary that the central part of the connector be able to flex enough to accommodate daughter boards varying from slightly below the nominal thickness to slightly above it while still applying approximately the correct pressure to the board. This requires that the contact areas be on the confronting surfaces of the U-shaped loops of the side wire portions and as far as the size of the components will permit from the bight of the central portion. If the J-shaped connectors are made with exactly that configuration, the flexible length, which includes the U-shaped loop and the part of the straight section from the loop to the solder is relatively short and makes such a J-shaped member so stiff that it is difficult to position it in the mother board accurately enough to cause it to exert exactly the desired pressure on the daughter board.

SUMMARY AND OBJECTS OF THE INVENTION

An individual connector capable of making contact with only one surface of a daughter board is formed, according to this invention, of round resilient wire bent into a shape basically similar to a "J" but with at least one offset in the straight section and with the other end of the loop extended back more or less parallel to the straight section and with the contact area on the extended part rather than on the loop itself. A number of such J-shaped connectors can be aligned side by side in a row to make contact with the connection areas adjacent one edge of a daughter board and on one surface of the board. A second row of similar connectors can be aligned as mirror images to those in the first row to make contact with connection areas on the other surface of the daughter board.

One of the difficulties with the J-shaped connector is in keeping the connectors properly positioned while they are being soldered to a mother board. The single end of a J-shaped connector according to the present invention is free to rotate in a hole in a mother board, and the connector must be held until the solder solidifies so that the contact area of that connector will be properly aimed toward the location where a specific connection area of a daughter board will be expected to be.

Good electrical connection between the connector and the daughter board will be determined by: the free location of the contact area of the connector before the daughter board is slid into place, the displacement of the contact area by the daughter board, and the resilience of the wire of which the connector is made. Forming one or more offsets in the proper part of the straight section of the connector and forming the offsets or offsets of the proper shape and direction to engage diametrically opposite surfaces of a hole in a support member allows each connector to be held in the support member without the possibility of having the solder cold flow.

It is one of the objects of this invention to provide an improved wire connector capable of being easily inserted into a hole in a support and held therein by solder, the connector being shaped to maintain its position after assembly with the support so that it substantially avoids cold flow of the solder.

Other objects will become apparent from the following description together with the drawings.

DETAILED DESCRIPTION OF THE INVENTION

Figure 1:
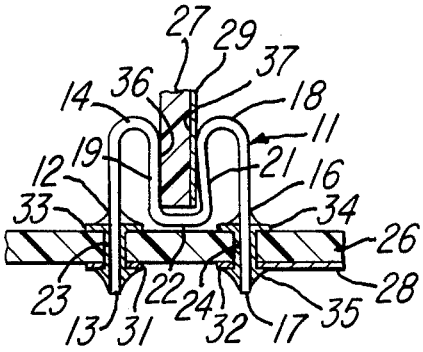
FIG-1 (PRIOR ART)
FIG. 1 shows an M-shaped connector formed according to the description in my U.S. Pat. No. 3,340,440.

The prior art M-shaped connector 11 shown in FIG. 1 is formed entirely of one piece of wire having a circular cross-section. A suitable material having high resilience and good conductivity is beryllium-copper wire having a diameter of 0.0201", although other materials have been used for certain purposes. The connector 11 consists of a first leg 12 that extends substantially straight from a free end 13 to a U-shaped loop 14, a second leg 16 that extends from a free end 17 to a U-shaped loop 18, and a U-shaped central portion that has sides 19 and 21 and a central U-shaped loop, or bight, 22 open in the opposite direction from the direction in which the loops 14 and 18 are open. The connector is symmetrical about the center of the bight 22. In order for the connector to have the proper spring characteristics, it is heat treated to harden it after it has been bent into shape.

In the connector 11, the legs 12 and 16 are shown as being straight and parallel to each other, but it is not necessary that they be precisely so. However, it is desirable that the free ends of the connector extend substantially parallel to each other so that the connector can easily be inserted in two holes 23 and 24 in a printed circuit board, referred to as a mother board to distinguish it from another printed circuit board 27, which will be called a daughter board.

The mother board 26 has a conductive pattern, or circuit, 28 formed on one of its surfaces to connect various circuit, components (not shown) together, as is well known in the electronics industry. Such circuits are not limited to one surface of the board nor is the board limited to one layer; double-sided and multi-layer boards are in common use.

The purpose of the connector 11 is to form an electrical connection between a specific part of the circuit 28 and a specific part of a circuit 29 printed on the daughter board 27. To accomplish this purpose, the legs 12 and 16 are soldered into place in the holes 23 and 24 in the board 26. This is made possible by providing the board 26 with conductive pads 31–34 that surround the holes 23 and 24 on at least one surface, and preferably on both surfaces, of the board. Any of the pads may be printed as an integral part of the circuits on the board, and the pad 32 is shown as part of the circuit 28, while the pad 31 is illustrated as a separate region. The connector 11 is not only electrically connected to the circuit 28 by being soldered to the pad 31 but is mechanically supported in a fixed, upright position relative to the board 26 by having both legs 12 and 16 joined to the pads 31–34 by solder 35. The strength of the solder bond is improved by plating conductive material not only on the flat surface of the board 26 to form the pads 31–34 but by plating the short cylindrical walls that define the holes 23 and 24 through the board. Such plated-through holes are well known in the industry.

The connector 11 is formed so that the proximal parts of the U-shaped bends, or loops, 14 and 18 are spaced apart by a distance slightly less than the thickness of a standard, copperclad printed-circuit board 27. Typically, such boards have a thickness of 0.062" and are laminated with copper etched to form circuits 29 having a thickness of about 0.003". The connector is formed so that regions 36 and 37 of the loops 14 and 18 are spaced apart by about 0.050" to make good contact with connection areas of the circuits 29. The regions 36 and 37 are closer to each other than any other parts of the loops 14 and 18, and they are also closer together than any parts of the sides 19 and 21 between the bight 22 and the loops 14 and 18. As a result, the contact areas 36 and 37 engage areas of the daughter board a short distance away from the edge of the board. It would not be desirable to try to make contact between the loops 14 and 18 and the very edge of the daughter board for several reasons. One reason is that such boards are usually beveled and the conductive material may not extend to the edge. Another reason is that the edge may be slightly jagged and not prefectly smooth.

A more important reason is that it is desirable for the contact area, 36 and 37 to be pressed against the opposite surfaces of the board 27 by a resilient force so as to accommodate slight variations in the thickness of different boards 27 within the tolerance permitted by industry standards. The closer the region of contact on the board is to the edge of the board, the shorter the sides 19 and 21 of the central part of the connector 11 will be and, therefore, the stiffer that part of the connector 11 will be. Any variation in the space between the contact areas 36 and 37 as the connector 11 is being formed or any variation in the thickness of the board 27 or in the copper lamination forming the circuit 29 on it will produce a large variation in pressure of the contact areas 36 and 37 against the board 27.

The customary practice in making printed circuit boards, such as the daughter board 27, is not to have the circuit printed on the board extend close enough to the edge to engage connectors. Instead, a band approximately 0.250" wide adjacent the edge is reserved as a connection region. Within that region, parallel, rectangular connection areas are printed on the surface of the board and are joined to appropriate parts of the printed circuit. These connection areas, which are side by side like piano keys, are referred to in the industry as fingers. In FIG. 1, it can be considered that the connection area of the printed circuit 29 engaged by the contact area 37 of the connector 11 is such a finger.

The pressure of the contact areas 36 and 37 is not entirely determined by the spring characteristics of the sides 19 and 21 and the bight 22. It is also determined by the resilience of the legs 12 and 16 and by the total length of the portions of the connector 11 from the points at which they are anchored to the board 26 to the ends of the loops 14 and 18 that define the contact areas 36 and 37. Therefore, the flexibility of the loops 14 and 18 and of the legs 12 and 16 help determine the force with which the connector presses against the board 27. Forming the connector so that the contact areas 36 and 37, are as far as possible out toward the tops, or centers, of the loops 14 and 18 makes the central part, that is, the sides 19 and 21 and the bight 22, as flexible as possible for a given overall configuration but makes the outer parts, including the legs 12 and 16 and the loops 14 and 18, relatively stiff. Bending the wire in such a way as to place the contact areas 36 and 37 closer to the bight 22 makes the central part of the connector stiffer and the side parts more flexible.

The overall pressure of the contact areas 36 and 37 against the board 27 can be partly contolled by applying suitable pressure to the connector 11 as it is being soldered in place in the mother board as described in my U.S. Pat. No. 3,940,849. A bar somewhat thinner than the board 27 is expected to be, but thicker than the free, unstressed, distance between the contact areas 36 and 37, is inserted between the contact areas before molten solder is allowed to flow over the pads 31 and 32 and up into the plated walls of the holes 23 and 24 and out along the pads 33 and 34. If the wire of which the connector 11 is made has a diameter of 0.0201", it is preferred to drill the holes 23 and 24 with a drill having a diameter of 0.032". The material of which the board is made is slightly resilient and it springs back to make the diameter of the holes slightly less than 0.032" after the drill bit has been withdrawn. In addition, the plating applied to the walls of the holes 23 and 24 further reduces the diameter of the holes to about 0.031". Still, there is some space between the outer surface of the legs 12 and 16 and the inner surface of the plated holes, and so insertion of a bar between the contact areas 36 and 37 can vary the locations of the legs 12 and 16 slightly, either by pushing them slightly farther apart or by tilting them slightly. When the molten solder solidifies in the plated holes 23 and 24 and on the pads around those holes on both surfaces of the board 26, the legs 12 and 16 will be locked substantially in the positions into which they were forced by pressure provided by the bar. My U.S Pat. No. 3,940,849 shows the use of such a bar, either separately or as a central divider in a carrier capable of holding many connectors like connector 11 in alignment so that they can all be easily inserted simultaneously into correspondingly aligned holes in a printed circuit board and held by the carrier while they are all being soldered in place.

The connector 11 is satisfactory for engaging a connector finger on either surface of the printed circuit board 27, but because its contact areas 36 and 37 are directly connected together by the central part of the connector, it cannot be used with printed circuit boards that have independent or isolated connector fingers on opposing surfaces. Printed circuits have become increasingly complex and many of them require so many connections in the available length along the edge of the board that it is necessary to provide electrically isolated connector fingers on both surfaces. The necessity of providing separate connections to connector fingers on each surface of a doublesided board gave the initial impetus to the present invention.

Figure 2:
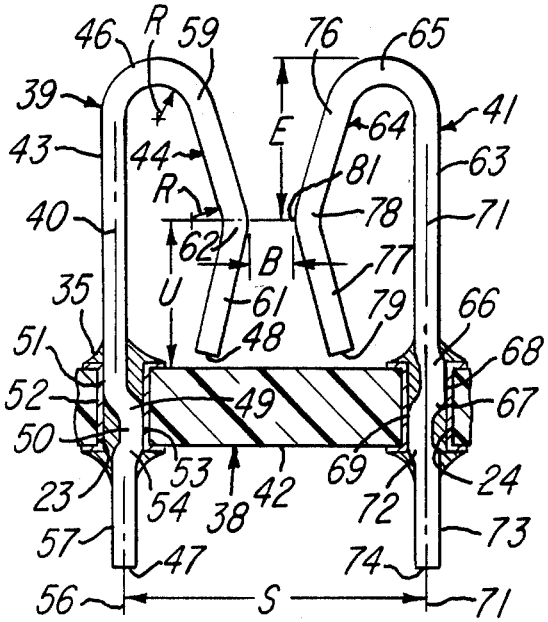
FIG. 2 shows a connector assembly with two embodiments of connectors according to the invention.

FIG. 2 is a cross-sectional view of a connector assembly 38 according to this invention. Only two connectors 39 and 41 are shown in this view, but it is to be understood that there are other such connectors aligned in two parallel rows behind them on an insulating support, typically a printed circuit board 42.

The connectors 39 and 41 are not identical but are two embodiments of connectors formed according to this invention. The connector 39, consists of a single piece of round wire that is both resilient and highly conductive. Beryllium-copper wire of the type and diameter used in the connector shown in FIG. 1 is the most satisfactory wire found so far, but there are other types of wire that are suitable for some purposes, and the invention should not be considered to be limited to one type and diameter of wire.

The wire is bent into a shape that somewhat resembles a J and consists of two parts 43 and 44 joined by a loop 46. The first part 43 extends from the loop 46 to one end 47, which, prior to insertion in the board 42, was a free end, and the other part 44 extends from the other free end 48 of the wire to the loop 46. The axis of the upper portion of the first part 43 is identified by reference numeral 40.

The part 43 has an offset 49 intermediate the end 47 and the loop 46 and normally closer to the end 47 than to the loop. The offset is essential to stable positioning of the connector in the support board 42 and is formed by bending the wire so that a section 50 of the wire is shifted to one side, relative to the upper portion of the part 43, by a predetermined amount. This amount is such as to cause the surface of the wire at the point 51 on the side of the offset 49 nearer the loop 46 to lie against, or substantially against, that part of the surface of the plating (usually copper plating) 52 farthest from the hole 24 and to cause the opposite surface of the wire at a point 53 adjacent the offset on the side thereof closer to the end 47 to lie against, or substantially against, a part of the surface of the plating 52 nearest to the hole 24. The size 0 of the offset 49 is defined as the distance that the axis of the wire at the point 53 is shifted laterally relative to the axis of the wire at the point 5 and is substantially equal to the difference between the diameter D of the hole 23 less the thickness T of the plating 52 in the hole and less the diameter d of the wire, or:

$$O \approx D - T - d$$

For example, in the case of a wire having a diameter of 0.0201" in a hole having an initial diameter of about 0.032" and a plating thickness of about 0.001", leaving an inner wall diameter of about 0.031", the size of the offset 49 needed to cause the points 51 and 53 to touch the surface of the plating when the part 43 is perpendicular to the board is only about 0.010", or, in this embodiment, about half of the diameter of the wire. However, the offset is not limited to that specific value. If the hole diameter is enlarged to make it easier to insert the free end 47, the offset may be made correspondingly greater.

The connector 39 is shown with a second offset 54 in the opposite direction but only about half the size of the offset 49. This returns the axis 56 of the portion 57 of the part 43 between the offset 54 and the end 47 to a position approximately coaxial with the hole 23. The advantage of the second offset is that the portion 57 will be aimed at the center of the hole 23 when the connector 39 is pushed perpendicularly toward the board 42. As a result, the sharp corners of the end 47 will not be likely to scrape across the plating 52.

The connector 39 is still held in the board 42 by solder 35 solidified in place, but, unlike the straight leg 12 in FIG. 1, pressure to the left on the upper end of the part 43 will fall directly against the relatively hard plating 52 as the point 51 is pressed against that plating. Furthermore, the rocking couple about the point 51 will be taken up by an increase in the pressure of the point 53 against the relatively hard opposite side of the plated hole 23. For this reason, the offset 49 between the points of contact 51 and 53 should be toward the second part 44 of the connector 39 rather than away from it. The offset 49 may thus be defined as being in the inward direction corresponding to the fact that the central plane of the structure in FIG. 2 is midway between the holes 23 and 24. If there is a second offset, like the offset 54, closer to the end 47 than the offset 49, the second offset should be in the outward direction.

The points 51 and 53 have been referred to as points of contact, but it is not necessary that the wire actually touch the plating 52; they may be separated by a layer of solder too thin to allow substantial shifting due to cold flow. In considering the amount of shifting that may take place due to cold flow, it must be kept in mind that the thickness of the board 42 is typically only 0.062", or about three times the diameter of the wire, and that the distance between the points 51 and 53 (as measured along the axis 56) is slightly less than the thickness of the board. The straight-line distance from the point 51 to the contact area 58 on the second part 44 of the connector 39 is several times as great as the distance between the points 51 and 53, and thus lateral shift in position of the contact area will be that much greater than lateral shift of the point 51 relative to the point 53 if solder cold flow takes place.

The second part 44 of the connector 39 is bent to form two portions 59 and 61. The portion 59 extends from the loop 46 to the bend 62. Overall, the part 44 is approximately parallel to the part 43. More precisely, if the end of the portion 59 that merges into the loop 46 were continued beyond the loop and if the end of the part 43 that merges into the loop were also continued beyond the loop, those extended ends would meet at an acute angle. In a similar way, if the portion 61 were extended beyond the end 48 until it intersected the axis 56, that intersection would also be at an acute angle and, in fact, at approximately the same angle as the intersection between the first part 43 and the first portion 59 of the second part 44 of the wire that forms the connector 39.

The connector 41 has first and second parts 63 and 64 and a loop 65 substantially identical with the corresponding parts 43 and 44 and the loop 46 of the connector 39. The difference between these embodiments is in their offset sections. The connector 41 has an additional offset 66 away from the second part 64 and located at approximately the point where the first part 63 enters the hole 24 through the insulating support 42. The lateral extent, or size, of this offset is only about half as great as the lateral extent of the offset 67 between points 68 and 69 in the offset section where the wire touches, or substantially touches, the inner surface of a plating layer on the wall of the hole 24. The advantage of the offset 66 is that it returns the axis 71 of the portion of the first part 63 between the loop 65 and the offset 66 to a position substantially coaxial with the hole 24 and with a portion 73 of the part 63 between a third offset 72 and one end 74 of the wire connector 41. This allows the connector 41 to be held in carriers having the same dimensions as those used to hold M-shaped connectors like the connector 11 in FIG.1 while placing the connectors 41 in the same pairs of rows of holes as the connectors 11. This will be further discussed in connection with FIGS. 3 and 4.

The second part 64 of the connector is bent to form two sections 76 and 77 joined together by a bend 78 and extending from the loop 65 to a free, second end 79. As in the connector 39, both parts 63 and 64 and the loop 65 of the connector are in one plane. More precisely, the axis of the wire that forms all parts of the connector 41 from the end 74 to the end 79 lies substantially in a single plane, which is the same as the plane in which the axis of all parts of the wire that forms the connector 39 lies when both connectors 39 and 41 are mounted in mirror-image position in the holes 23 and 24. In addition, the rounded cross-section of the wire at all points along the connectors 39 and 41 remains substantially constant. Although the wire that forms the connectors 39 and 41 has some thickness, these and other connectors that will be referred to as being in mirror-image relationship will be considered as being coplanar or substantially so. Whether or not each connector on one side of the central plane of the complete structure is directly opposite a connector on the other side of the central plane, it is important that each connector be substantially perpendicular to the central plane so as to avoid having pressure from a daughter board tend to rotate the connector in its hole 23 or 24.

In order to make satisfactory contact with connection fingers on opposite sides of a printed circuit board of standard 0.062" thickness, the distance B between the contact area 58 on the connector 39 and a corresponding contact area 81 on the convex surface at the bend 78 on the connector 41 should be approximately 0.040". Such close spacing is desirable because of the length of the spring in each of the connectors. This length is the total distance from the point at which the connectors emerge from the solder holding the connectors in place in the board 42, up the respective first parts 43 and 63, around the respective loops 46 and 65, and down the respective first portions 59 and 76 to the respective contact areas 58 and 81. Moreover, these long springs are not made more rigid by any other parts, such as the two sides 19 and 21 and the bight 22 in FIG. 1. The sloping portions 59 and 76 form a long entrance, or throat, to the contact areas 58 and 81, which makes it easier to insert a daughter board between these contact areas than to insert the board 27 into the throat between the loops 14 and 18 in FIG. 1. The total length E of the entrance for connectors of the type described is typically about 0.135" out of a total height of about 0.260" from the upper surface of the board 42 to the tips of the loops 46 and 65. The loops 46 and 65 and the bends 62 and 78 each have an inner radius of about 0.025". The arc of the loops 46 and 65 is about 150° to 165°, which would make the acute angle between the first part 43 and 63 of each of the connectors 39 and 41, respectively, and the first portions of 59 and 76 of the second part about 30° to 15°. The second portions 61 and 77 are each bent to form an obtuse angle of about 120° to 150° with the respective first portions 59 and 76, and the distance U from the center of the contact areas 58 and 81 to the board 42 is about 0.125". The center-to-center spacing, S, between the holes 23 and 24 is about 0.250", and if both of the connectors were the same as the connector 41, the axes of the upper portions of the first parts (the part 63 and an identical mirror image) would be the same 0.250".

On the other hand, if both of the connectors were identical with the connector 39 and were inserted in the holes 23 and 24 having a center-to-center spacing of 0.250", the fact that the upper portion of the connector 39 is offset by about 0.005" from the axis 56 of the lower portion 57 would cause the distance between axis 40 of the upper portion of the part 43 and its identical mirror image to be 0.260". The disadvantage of such a spacing will be discussed in connection with FIGS. 3 and 4.

Figure 3:
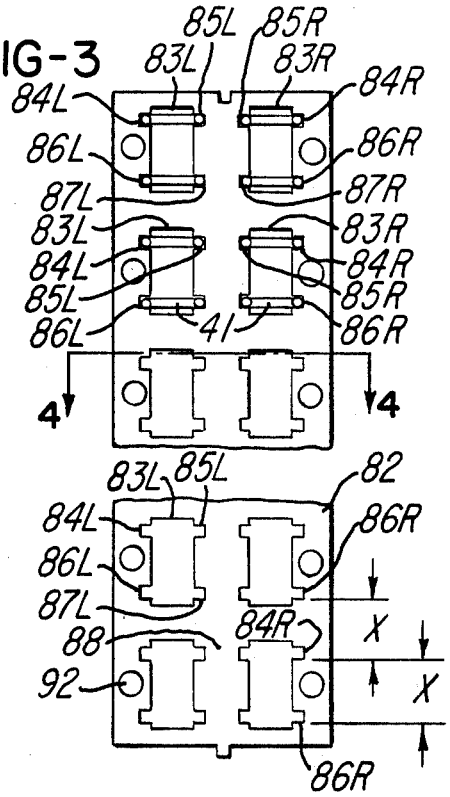
FIGS. 3 and 4 show a carrier to hold the connectors of this invention as well as the prior art connectors in FIG. 1.
Figure 4:
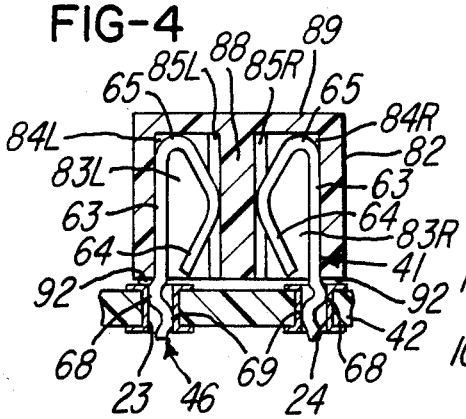

FIGS. 3 and 4 show a carrier 82 that is basically the same as that in my U.S. Pat. No. 4,061,405 but with certain important improvements. Like the carrier in that patent, the carrier 82 is molded of a suitable material, such as glass-filled polyester, having good molding characteristics and dimensional stability as well as sufficient resistance to heat to allow connectors held by the carrier to be soldered in place by a wave soldering technique. The carrier has a number of pairs of identical, generally rectangular recesses 83L and 83R. The recesses are arranged in two rows with each recess in one row directly alongside a recess in the other row. Unlike the carrier in U.S. Pat. No. 4,061,405, each recess has four grooves 84L–87L and 84R–87R, respectively, near its four corners, rather than just two outer grooves like the grooves 84 and 86, and each groove is wide enough to accommodate wire of the diameter used in making the connectors 11 in FIG. 1 and the connectors 39 and 41 in FIG. 2. Bottom views of eight of the connectors 41 are shown in FIG. 3, and two of the connectors 41 are shown in full view in the cross-section of the carrier in FIG. 4. The connectors are arranged in mirror image position, and the grooves 84L and 84R hold the first parts 63 while the grooves 85L and 85R hold the respective second parts 64. The carrier 82 has a central barrier 88 thick enough to compress the second part 64 of each connector 41 toward its first part 63 with enough force to prevent the connector from falling out of the carrier. The spacing X between the grooves 84, 85 and the grooves 86, 87 is the same as the spacing X between the grooves 86, 87 in one recess and the grooves 84, 85 in the next recess, and that spacing is selected according to the standard spacing in the support 42, for example 0.100".

One of the connectors 11 of FIG. 1 could be held in the aligned grooves in two adjacent recesses 83L and 83R, such as the grooves 84L and 84R of the two recesses 83L and 83R in FIG. 4, and the bight 22 would keep the connector from being pushed out of the top of the carrier in attempting to align the ends 13 and 17 with holes in a supporting board, such as the board 26. However, in order to prevent the J-shaped connectors 41 (or 39) from being pushed out in attempting to align the ends 74 (or 47) with holes in the board 42, the carrier 82 is provided with a top plate 89. The interior dimension of each groove 83L and 83R is such that, when the top of the loop 65 strikes the top plate 89, the end 74 will extend the proper distance to fit the offset section including the points 68 and 69 inside one of the plated holes 24 in the board 42. In pressing a large number of ends 74 into their respective holes simultaneously, the plating in the holes helps to make the passage smoother. The surface 91 of the carrier, which is the surface that faces the board 42, has a hemispherical knob 92 alongside each recess 83 to separate the surface 91 from the board and thereby prevent melted rosin from the soldering operation from gluing the carrier 82 to the board 42.

Figure 5:
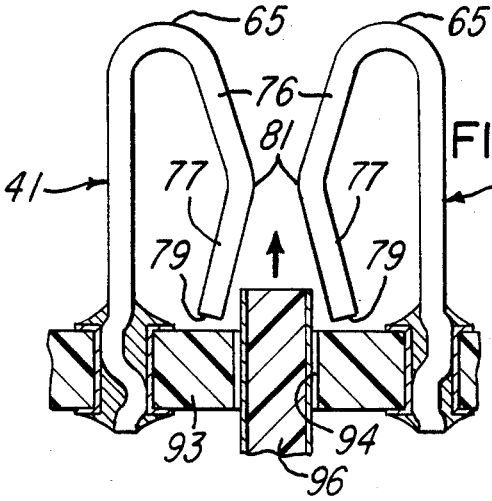
FIG. 5 shows a connector assembly for accepting a daughter board into engagement with connectors by way of a slot in the mother board in which the connectors are supported.

FIG. 5 shows two rows of the connectors 41 inserted in a board 93 that has a slot 94 between the rows. The slot is formed so that its width is just sufficient to allow a printed circuit board 96 to be inserted through it and into engagement with the contact areas 81 of the connectors. The connector 11 in FIG. 1 cannot accommodate such a reversal of the direction of insertion because the bight 22 would be in the way. Thus, the separate connectors 41 (or 39) not only allow separate electrical contact with both surfaces of a daughter board but allow the daughter board to be inserted in either direction. The second portions 77 of the second parts 64 of the connectors 41 form just as satisfactory an entrance throat as do the first portions 76, even though the second portions 77 stop just a little short of engaging the board 42. A typical distance between the ends 79 and the board 42 may be about 0.010".

Inserting the board 96 through the slot 94 to engage the connectors 41 allows the edges of the slot to help support the board 96, which may be especially useful if the structure is likely to be subjected to mechanical vibration. Such reverse insertion may also allow the structure to be more compact.

The 0.250" spacing S in FIG. 2 is based on one of the spacing standards in the printed circuit board industry and is the same spacing used in designing the connectors in FIG. 1, but it is not the only spacing that is an industry standard. Some printed circuit boards require a spacing S of only 0.200". While the connectors in FIGS. 2–5 could be modified by bending the loops 65 more sharply and perhaps making the angle between the portions 76 and 77 of the second part 64 more obtuse, such modifications would reduce the flexibility of the connector and would thus reduce its ability to engage oversized or undersized daughter boards with the proper pressure. Furthermore, moving the first parts 63 of mirror-image connectors close enough together to fit into holes with a spacing S of only 0.200" would require the dimensions of the carrier 82 in FIGS. 3 and 4 to be modified correspondingly, and such dimensional change of a molded part would require an expensive, new mold.

Figure 6:
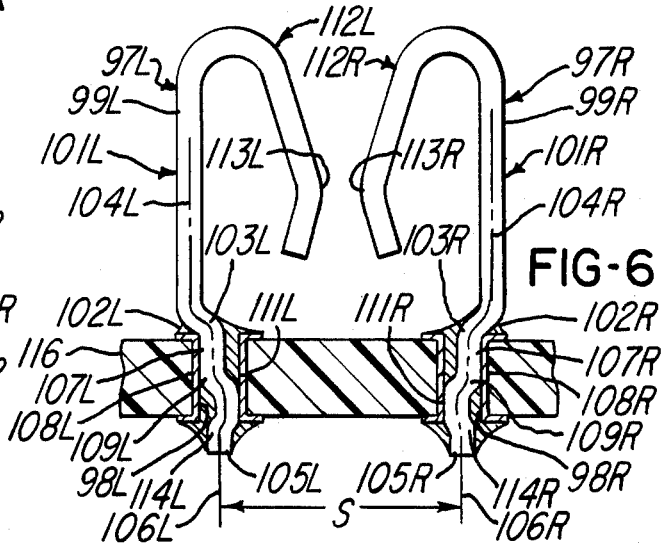
FIG. 6 shows a modified embodiment of connectors according to the present invention with additional offsets to allow them to be held in the carrier of FIGS. 3 and 4 but inserted in holes more closely spaced than the holes in FIG. 4.

FIG. 6 shows identical, modified connectors 97L and 97R placed in mirror-image relationship in holes 98L and 98R having a center-to-center spacing S of 0.200". Each of these connectors has an upper portion 99L and 99R of a first part 101L and 101R that is substantially straight and is held by solidified solder 102L and 102R in the respective hole 98L and 98R. The first parts 101L and 101R have additional offsets 103L and 103R to allow the spacing between the axes 104L and 104R of the upper portions 99L and 99R to be 0.250" while still allowing the axes 106L and 106R of the holes 98L and 98R and of the lower portions 105L and 105R to have a spacing S of 0.200", as measured along the supporting mother board 100. Offsets 103L and 103R of 0.020" allow the upper portions 99L and 99R to occupy the same positions in the holder 82 in FIGS. 3 and 4 as do the parts 63 shown in those figures. At the same time, regions 107L and 107R immediately below the offsets 103L and 103R are in contact with plating 108L and 108R on mutually distal parts of the inner walls of the holes 98L and 98R, and immediately below the regions 107L and 107R are offsets 109L and 109R below which are regions 111L and 111R of the respective connectors in contact with mutually proximal parts of the inner walls of the holes. As in embodiments described in connection with FIGS. 2–5, the connectors 97L and 97R have second parts 112L and 112R that have mutually confronting contact areas 113L and 113R to engage connector fingers on an opposite surface of a printed circuit board inserted between those contact areas. With the dimensions given in the embodiment used in FIG. 6 to illustrate, but not to limit, the invention, the free distance between the contact areas 113L and 113R prior to insertion of a daughter board between them is about 0.030". Insertion of a daughter board, such as the board 96 in FIG. 5, puts outward pressure on both contact areas 113L and 113R, and that pressure causes the regions 107L and 107R to press outwardly against the plating 108L and 108R and the regions 111L and 111R to press inwardly against the plating. Such pressure directly against the plating or at least against a very thin layer of solder prevents or substantially eliminates cold flow of the solder 102L and 102R. As in the case of the other embodiments, the connectors 97L and 97R have half-size offsets 114L and 114R that return the lower portions 105L and 105R to positions concentric with the holes 98L and 98R. The spacing between the regions 107L and 111L and between the regions 107R and 111R, measured perpendicularly to the surfaces of the mother board 116 is less than the thickness of the mother board, just like the distance between the points 51 and 53 or the points 68 and 69 in FIG. 2. The distances between the offsets 103L and 114L and between the corresponding offsets 103R and 114R can be greater than the thickness of the board 116 but are preferably not much greater than that thickness.

What is claimed is:

1. A connector to be supported in a hole in an insulating support member, said connector comprising a continuous length of wire having a rounded cross section and first and second free ends, the wire being bent into a generally J-shaped configuration comprising:

(a) a first part;

(b) a second part displaced in one direction from the first part; and (c) a U-shaped loop integrally joining the first and second parts, the first part extending from the first end to the loop and being bent to form, in a limited region intermediate the first end and the loop, a first offset to engage one side of the hole to brace the first part against the opposite side of the hole, the direction of the first offset from the portion of the first part between the first offset and the U-shaped loop being the same as the direction in which the second part is displaced from the first part and the extent of the first offset being about one-half the diameter of the wire, the first part also being bent to form a second offset between the first free end and the first offset, the second offset being in the opposite direction from the first offset and of approximately half the size of the first offset to facilitate alignment with and insertion in the hole, and the second part extending from the loop to the second end alongside a substantial portion of the first part between the loop and the first offset, the second part comprising:

(i) a bend between the loop and the second free end, and (ii) a convex contact surface area on the surface of that portion of the bend most remote from the first part to engage and to bear resiliently against a mating structure.

2. The connector of claim 1 in which the first and second parts and the loop are all substantially in a common plane.

3. The connector of claim 1 in which the offset has a size not substantially greater than the diameter of the wire.

4. The connector of claim 1 in which the substantial portion of the first part comprises a substantially straight length of wire merging integrally into the loop, said connector further comprising:

a third bent offset between the first-named offset and the straight length of wire and merging integrally into the straight length of wire; and a short length of the same wire merging integrally, at one of its ends, into the first offset and, at its other end, into the third offset, the length of the short length of wire being less than three times the diameter of the wire.

5. The connector of claim 4 in which the third offset is bent in the same direction as the first-named offset, and the size of the third offset measured perpendicularly to the straight length of wire is greater than the size of the first offset.

6. The connector of claim 4 in which the third offset is in the opposite direction from the first offset, and the size of the third offset measured perpendicularly to the length of wire is less than the size of the first offset, and the length of the short length of wire is less than twice the diameter of the wire.

7. A connector assembly comprising:

a main insulating support member of predetermined thickness, said member comprising:

a pair of rows of holes;

conductive pads printed on the support member surrounding each of the holes; and first and second rows of connectors, each held by solidified solder joined to at least one of the pads surrounding a respective one of the holes, the connectors in the first row being mounted in substantially mirror image relationship to the connectors in the second row to support and make firm electrical contact with a subsidiary insulating support member, each of the connectors in each row comprising a continuous length of wire having first and second ends and a rounded cross section with a diameter less than the diameter of the respective hole, the wire being bent into a generally J-shaped configuration to form a loop intermediate its ends with a first part of the wire extending from the loop to a first end and a second part of the wire extending from the loop to the second end and displaced in one direction from the first part toward the other row, the first part being bent to form an offset located within one of the holes and within the thickness of the main insulating support member and soldered to at least the respective one of the pads, the size of the offset measured perpendicularly to the axis of the respective hole being substantially equal to the diameter of the hole less the diameter of the wire, and the direction of the offset from the portion of the first part between the offset and the U-shaped loop being the same as the direction in which the second part is displaced from the first part, and the second part of the wire being bent to form a convex, rounded contact area intermediate the loop and the second end, the first and second parts and the offset of each of the connectors being in a respective plane substantially perpendicular to a first plane perpendicular to the main insulating support member and tangent to the contact areas of the connectors in the first row, the minimum distance between the first plane and a second plane, which is parallel to the first plane and tangent to the contact areas of the connectors in the second row, being less than the thickness of the subsidiary insulating support member.

8. The connector assembly of claim 7 in which the length of the second part of the wire from the loop to the second end is shorter than the length of the portion of the first part from the loop to the offset section, whereby the second end of the wire is spaced from the insulating support member when the offset section is substantially within the support member.

9. The connector assembly of claim 8 in which the insulating member comprises a slot substantially midway between the pair of rows of connectors, the width of the slot being greater than the distance between the first and second parallel planes to allow the subsidiary insulating support member to extend through the slot and into firm engagement with the contact areas of both rows of connectors.

10. The connector assembly of claim 7 in which the first part of each of the connectors comprises a second offset extending the opposite direction from the first-named offset and within the thickness of the main insulating support member.

11. The connector assembly of claim 10 in which the first part of each of the connectors comprises a third offset close to the first-named offset but outside of the respective hole and extending in the same direction relative to the remainder of the first part between the third offset and the loop as does the first-named offset.

* * * * *